US008479007B2

(12) United States Patent
Tame

(10) Patent No.: US 8,479,007 B2
(45) Date of Patent: Jul. 2, 2013

(54) DOCUMENT CREATION AND AUTHENTICATION SYSTEM

(75) Inventor: Gavin Randall Tame, Pretoria (ZA)

(73) Assignee: Dexrad (Proprietary) Limited (ZA)

( * ) Notice: Subject to any disclaimer, the term of this patent is extended or adjusted under 35 U.S.C. 154(b) by 993 days.

(21) Appl. No.: 11/596,750

(22) PCT Filed: May 17, 2005

(86) PCT No.: PCT/IB2005/001332

§ 371 (c)(1),
(2), (4) Date: Jun. 25, 2007

(87) PCT Pub. No.: WO2005/111950

PCT Pub. Date: Nov. 24, 2005

(65) Prior Publication Data

US 2007/0256137 A1 Nov. 1, 2007

(30) Foreign Application Priority Data

May 17, 2004 (ZA) ..... 2004/3770

(51) Int. Cl.
*H04L 29/06* (2006.01)

(52) U.S. Cl.
USPC ..... 713/178; 713/182; 713/183; 713/184; 713/185; 713/186; 726/26; 726/27; 726/28; 726/29; 726/30

(58) Field of Classification Search
USPC ..... 726/26–30; 713/178, 182–186; 705/26
See application file for complete search history.

(56) References Cited

U.S. PATENT DOCUMENTS 5,806,040 A 9/1998 Vensko
6,263,438 B1 * 7/2001 Walker et al. ..... 713/178

(Continued)

FOREIGN PATENT DOCUMENTS

WO WO 01/03077 A1 1/2001

OTHER PUBLICATIONS

HP Labs, Document Authentication System Preventing and Detecting Fraud of Paper Documents, IIIT, Bangalore, Jul. 7, 2007.*

*Primary Examiner* — Taghi Arani
*Assistant Examiner* — Josnel Jeudy
(74) *Attorney, Agent, or Firm* — R. Blake Johnston, Esq.; DLA Piper LLP (US)

(57) ABSTRACT

A method and system for creating and authenticating a document are disclosed. According to the method, a user of a document creation system is registered to ensure the creation of an authentic document. A document is then created having a user discernable portion and an encoded portion. The encoded portion includes identification data identifying the registered user of the document creation system; as well as contents data corresponding to at least part of the user discernable portion of the document, and authentication data. A central record of the document is created, the record comprising data which corresponds at least partially to the data in the encoded portion of the document. To authenticate the document subsequently, an image of the encoded portion of the document is acquired, for example using fax machine or a camera of a mobile telephone and transmitted to an authentication center. The data in the encoded portion of the document is extracted and the document is authenticated by comparing the extracted data with data in the respective central record. Preferably, the encoded portion of the document contains instructions relating to the authentication process for obtaining biometric data from the respective user of the document creation system. For example, the encoded portion of the document may comprise a password, and the document creator is contacted to generate a live voiceprint of the password to be compared with a stored voiceprint for verification purposes. A system for creating and authenticating a document by the above method are also disclosed.

22 Claims, 2 Drawing Sheets

U.S. PATENT DOCUMENTS

| | | | | |
|---|---|---|---|---|
| 6,681,205 | B1 * | 1/2004 | San Martin et al. | 704/243 |
| 2002/0031230 | A1 * | 3/2002 | Sweet et al. | 380/278 |
| 2002/0138357 | A1 | 9/2002 | Dutta | |
| 2003/0116630 | A1 * | 6/2003 | Carey et al. | 235/462.09 |
| 2003/0128099 | A1 | 7/2003 | Cockerham | |
| 2004/0153649 | A1 * | 8/2004 | Rhoads et al. | 713/176 |
| 2011/0010470 | A1 * | 1/2011 | Hulbert et al. | 710/13 |

* cited by examiner

DOCUMENT CREATION AND AUTHENTICATION SYSTEM

BACKGROUND OF THE INVENTION

This invention relates to a document creation and authentication system and method.

Due to a general increase in fraud and terrorist activity, there is an increasing need for the authentication of documents, particularly paper documents. By way of example, the availability of computers and relatively sophisticated printing equipment makes it fairly easy to produce fraudulent identity documents, degree certificates, labels and other documents.

Where document authentication techniques exist, they tend to rely on the use of expensive, sophisticated equipment and are generally not suitable for widespread use.

It is an object of the invention to provide a document creation and authentication system and method that can be used relatively widely.

SUMMARY OF THE INVENTION

According to the invention there is provided a method of creating a document, the method comprising:

registering a user of a document creation system to ensure that an authentic document is created;

creating a document having a user discernable portion and an encoded portion, the encoded portion including identification data identifying the registered user of the document creation system, contents data corresponding to at least part of the user discernable portion of the document, and authentication data; and creating a central record of the document comprising data corresponding at least partially to the data in the encoded portion of the document.

The method may further comprise allocating a unique document identification code to the document.

The unique document identification code may comprise data indicating the nature of the document, and a date/time stamp, for example.

Preferably, the unique document identification code is included in the encoded portion of the document and in the central record of the document.

The data identifying the user of the document creation system may comprise a unique user identity code.

The authentication data preferably comprises biometric data obtained from the user.

For example, the biometric data may comprise fingerprint or voiceprint data.

The unique user identity code, together with personal details of the user and the authentication data, is preferably stored in a database as a central record accessible for authentication purposes.

The encoded portion of the document and/or the respective record in the central database may include instructions relating to an authentication process to be followed when authenticating the document.

For example, the instructions may comprise a password to be spoken by a user of the document creation system to identify the user biometrically.

The encoded portion of the document is preferably a machine-readable symbol that is printed in a size and format suitable for acquisition by a conventional imaging device to permit acquisition and transmission of the encoded portion of the document to an authentication center.

For example, the size and format of the encoded portion are preferably selected to be compatible with conventional fax machines and relatively low resolution digital cameras such as those provided on mobile telephones.

Preferably, the encoded portion is printed in a size, density and format that can successfully be acquired by imaging devices having a resolution of 200 DPI or less.

In a preferred embodiment of the invention, the encoded portion of the document is printed as a two-dimensional symbolic barcode.

The two-dimensional symbolic barcode is preferably encrypted and incorporates error correction data.

Further according to the invention there is provided a method of authenticating a document created by the above defined method, comprising:

acquiring an image of the encoded portion of the document to be authenticated;

transmitting the image to an authentication center;

decoding the image to extract the data contained therein; and authenticating the document by comparing the extracted data with data in the respective central record.

The authentication step may include contacting the respective registered user of the document creation system, receiving current identification data from the user, and comparing the received current identification data with data in the central record and the data extracted from the encoded portion of the document.

The current identification data received from the user may be biometric data such as fingerprint or voiceprint data.

Where the encoded portion of the document contains instructions relating to the authentication process, the biometric data may be obtained according to said instructions.

For example, the instructions may comprise a password to be spoken by the user of the document creation system to permit acquisition of a current voiceprint for comparison against a stored voiceprint of the password.

The invention extends to a system for creating and authenticating a document, the system comprising:

a secure document creation system accessible by an authorized user to create an authentic document having a user discernable portion and an encoded portion, the encoded portion including identification data identifying the registered user of the document creation system, contents data corresponding to at least part of the user discernable portion of the document, and authentication data;

a central database for storing a central record of the document comprising data corresponding at least partially to the data in the encoded portion of the document; and an authentication center for receiving an image of the encoded portion of the document to be authenticated, decoding the image to extract the data contained therein, and authenticating the document by comparing the extracted data with data in the respective central record.

The authentication center may comprise a voice identification server arranged to compare biometric data, such as voiceprint data, received from a document creator/signatory identified in the encoded portion of the document, with current biometric data, thereby to verify the identity of said creator/signatory.

Preferably, the biometric data is voiceprint data, the voice identification server being arranged to contact the document creator/signatory and to guide the document creator/signatory through a voice identification procedure with voice commands.

DESCRIPTION OF PREFERRED EMBODIMENTS

The first step in the operation of the method of the invention is the registration of a user of a document creation system, for purposes of access control and document creator accountability. When a user is registered for the first time, their personal identification details such as their name, identity number and other details, as well as biometric data such as fingerprint data, are recorded and registered in a user access control database against a unique user identity code. The registration can be carried out locally or via an on-line central transaction server.

Figure 1:
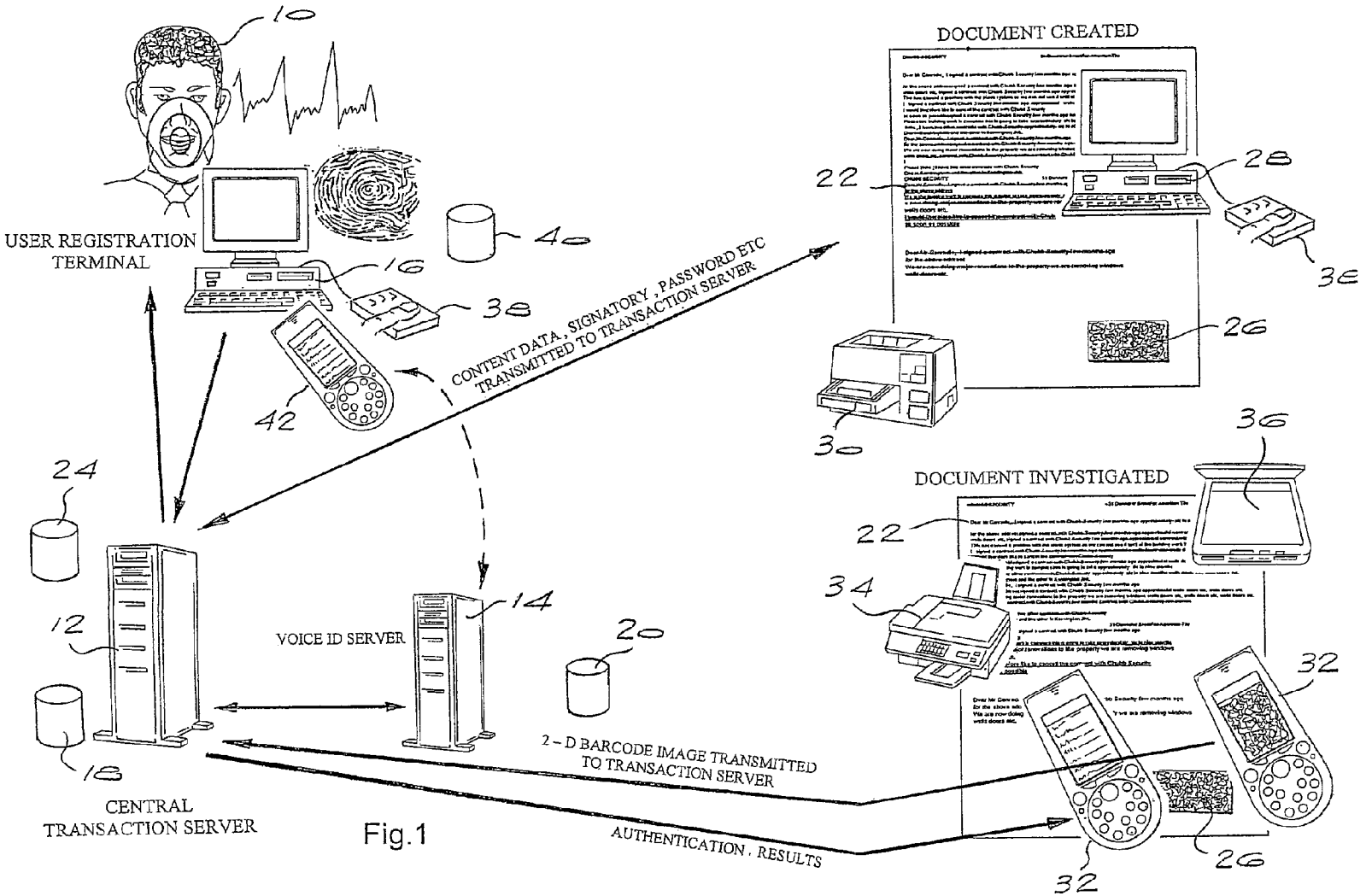
FIG. 1 is a simplified schematic diagram of a system and method for creating and authenticating documents according to the invention.

The registration step and further major steps of the method are indicated schematically in FIG. 1.

Using a user registration terminal 16, a unique user identity is allocated automatically when the registration process is commenced. A user 10 to be registered places his/her finger on a fingerprint acquisition device 38, typically three times. A fingerprint biometrics template is derived from the three readings thus obtained and is stored in a user access control database 40 with the unique identification code as a key field of the user identification record. Other user identification data such as the user's name, address, identity number and other information is also stored in the database record. This user biometrics template is used for logical control, allowing a user to create and print documents only if there is a successful finger match of the registered finger template with that of a live finger scan during the document creation process.

In order to create documents according to the method of the invention, a further registration step is required to register the user as a document creator/signatory so that it can be verified during the authentication stage that this person is the true signatory of the document. A document creator/signatory can be verified during the document authentication stage as the true creator or signatory of the document by reference to a recorded voice password template linked to the unique user identity code of the creator/signatory as described above. For this purpose, a sound file of the user's pronunciation of the password is acquired and linked to the user's unique user identity code. This can be done by telephone, whether a conventional landline telephone or a mobile telephone, or by means of a voice recognition system connected to a personal computer, for example. Importantly, a contact telephone number for the user is also recorded.

The user's identification number, password sound file and telephone number are transmitted to a central transaction server 12 which records the voice identification data and other details in a document signatory database 18. (For purposes of illustration, it is assumed that the user has a mobile telephone 42.) The central transaction server 12 transmits the voice identification data on to a voice identification server 14 where it is stored on an associated voice identification database 20 together with the unique user identity code. A message indicating the registration status of the signatory is sent back to the central transaction server which records the status data in the document signatory database. A remote registration/creation station 16 can thus communicate with the central transaction server and enquire about the status of a particular signatory.

During an authentication process, the voice identification server 14 uses the stored telephone number and other identification data to contact the creator/signatory 10 and guide them through the voice identification process via prerecorded or computer generated voice instructions, so that their recorded live voice can be matched with the voice template registered on the voice identification server. In this manner the creator/signatory is identified, as described in more detail below.

The above described registration process will generally only be required to be performed once, but it will be understood that the process is a prerequisite to the subsequent document creation and authentication steps.

Creation of a specific document 22 according to the method of the invention is carried out at a document creation terminal 28 using a conventional document creation application, such as Microsoft Word (trademark) together with purpose-written document creation software which can integrate with the document creation application. Alternatively, an existing conventional document can be imported into the secure document creation software.

Firstly, the contents data which is to be placed in an online contents database 24 and a secure two-dimensional barcode 26 is created. This is done by first selecting the contents to be in the content database and then selecting the contents to be included in the two-dimensional barcode. This task is performed manually in some applications or can be automated in other specific applications.

The document is allocated a unique identity code (which includes a date/time stamp) and the user is requested to supply identifying details of the document, such as the applicable name and subject of the document.

If the document is to be digitally signed with the signatory's voice identification, a document signatory password is supplied. This password permits the identification of the signatory's voice depending on the level of security required. (In this description it is assumed that the document is required to be digitally signed, that is, a "voice signature" using the password is to be used.)

The contents data selection for the contents database, the unique document identity code, the document details and the document signatory password are transmitted to the central transaction server 12 and recorded in the contents database 24.

The contents required for the two-dimensional barcode, the unique document identity code, document details and document signatory password are compressed and encrypted. This data is structured with a header structure and the contents, and a two-dimensional barcode is created. The document is printed with the human discernable content and the machine readable two-dimensional barcode, using a laser printer 30 or another suitable printer. The document is then issued and disseminated.

At any subsequent time, remote authentication of the document, including verification and identification of the signatory, can be performed. It is in this respect that the invention is expected to have a large impact on the security of documents that can be authenticated almost anywhere.

A typical authentication process proceeds as follows.

The two dimensional barcode image 26 on the document 22 to be authenticated is acquired with a either a digital image enabled cellular phone 32, a facsimile machine 34 or an image acquisition device such as a scanner 36 connected to a computer (desktop or portable). The image is transmitted to the central transaction server 12. The means of communication can be a cellular telephone network, a conventional telephone/fax line, e-mail, and even a Web based system utilising the Internet, for example.

The central transaction server receives the image and spawns a document transaction with a unique transaction number. The telephone number, fax number or e-mail address of the sender is recorded in the transaction data. The two-dimensional barcode image is decoded. The header data is extracted and this with the rest of the two-dimensional barcode data is stored in the transaction data.

The header is analysed to determine the structure of the data, the type of transaction and any instructions contained in the data. The unique document identification code within the data is used to access the data within the central contents database record for this document. The data is authenticated and verified according to instructions within the two-dimensional barcode and/or the contents database 24.

If the signatory needs to be positively identified, the document signatory password is sent to the voice identification server along with the telephone number of the document creator/signatory and the transaction number. The telephone number of the creator/signatory is obtained from the two-dimensional barcode data or, if absent, directly from the voice identification database.

The voice identification server 14 dials the number of the telephone 42 of the document creator/signatory and guides the document creator/signatory through a voice identification procedure with voice commands. The signatory pronounces the voice password, which is analysed and verified. The results of the identification are conveyed back to the central transaction server which has pended the transaction for a set period awaiting for the voice identification results.

Any other instructions such as transaction approvals are carried out by the central transaction server.

The central transaction server records the results of the signatory identification, authentication and verification in the transaction data for future reference. The results (authentication details, partial or full content details and signatory results) are sent back to the enquirer according to instructions in the barcode and/or content database. The results can be sent back in the form of an SMS message, fax or e-mail message, for example.

The above process describes the typical flow of the method of the invention. It is not a set procedure but rather a flexible procedure that can be adapted to many diverse document, labelling and two-dimensional barcode marking applications and solutions.

Figure 2:
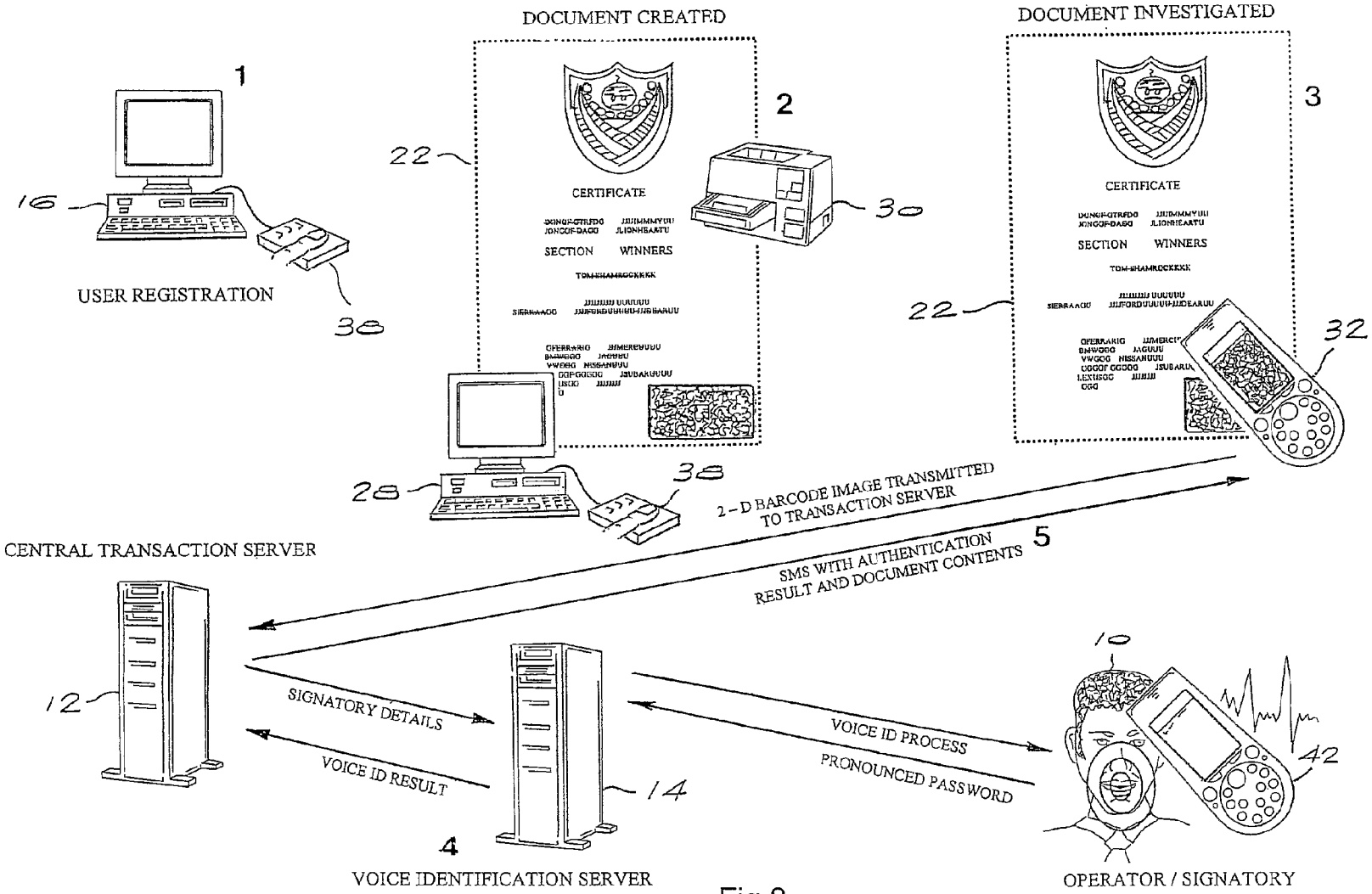
FIG. 2 is a schematic diagram illustrating an example of the application of the invention.

To illustrate the operation of the invention in practice, the creation and subsequent authentication of a specific document will now be described with reference to FIG. 2. In this example, the document to be created is a degree certificate or other educational results certificate, and a cellular telephone having a built-in camera will be used in the authentication process.

The example is a certificate, diploma, degree and results certificate authentication application. This is a complete application and is not integrated into another application. The certificate generation process is a part of the system and the entire contents of the certificate is incorporated in the two-dimensional barcode. The certificate contents are not, in this example, stored in the contents database, only the identifying details of the document and the instructions. The example is illustrated schematically in FIG. 2, which shows major steps in the document creation and authentication processes.

Secure Access to the Document Creation System (Step 1)

- The user or operator gains access to the system using his/her finger biometrics and password for authorised, identified access or registration.
- The operator's name is entered into the transaction log so that the transaction can be linked to the operator via the log.

Creation of the Document (Step 2)

- The details of a particular certificate are entered by the operator, with the recipient's name, the date, subjects and subject marks achieved, for example.
- The unique document identity code, title, creator details and the document signatory password(s) of the signatory or signatories for the certificate with their telephone numbers are sent to the central transaction server's contents database.
- The data structure for the two-dimensional barcode is constructed with the header data and the entire contents of the certificate.
- The two-dimensional barcode data is compressed and encrypted and encoded into a two-dimensional barcode image.
- The certificate is printed with its human readable contents (the conventional certificate contents) and the barcode.
- The certificate is issued.

Authentication of the Document (Step 3)

- The two-dimensional barcode of the certificate is imaged with a cellular telephone equipped with a digital camera by an enquirer wishing to establish the authenticity of the certificate.
- The resulting image is sent to the central transaction server's telephone number.
- The central transaction server registers the transaction and records the sender's (i.e. the enquirer's) cellular phone number.
- The two-dimensional barcode image is decoded and the header is stored with the transaction data.
- The document signatory password(s) and telephone and transaction number are sent to the voice identification server and the transaction is pended, awaiting the results from the voice identification server. (Step 4 is carried out at this point and then this procedure continues).
- Once the results of the voice signature identification have been received, these results and that of the transaction are compiled into an SMS message.

Voice Identification of the Signatory (Step 4)

- Using the information received from the central transaction server, the voice identification server dials the telephone number of the operator/signatory who created the document.
- The signatory is guided by voice commands through the identification process, which is a very short process as it requires only the document signatory's password to be pronounced. The pronounced password is analysed and verified.
- The results of the voice identification are sent back to the central transaction server with the transaction number.

Communicating the Results (Step 5)

- The transaction server uses the cellular telephone number it received when the enquiry was received in step 3 (i.e. the telephone number of the enquirer) to send an SMS message back to the enquirer with the signatory identification results and the contents of the two-dimensional barcode, allowing the enquirer to compare the contents of the certificate in question with the contents of the SMS and thus to verify the certificate, both in terms of its authenticity and contents.

It will be appreciated by those skilled in the art that aspects of the above described process could be varied without departing from the principles of the invention. For example, the functions of the central transaction server and the voice identification server could be combined, or more likely distributed amongst several servers.

The invention provides a method and system that make it possible to verify the authenticity of many different kinds of document from remote locations, using widely available current technology such as fax machines and mobile telephones with relatively low resolution built-in digital cameras, without the need for highly sophisticated and specialized equipment.

The invention is applicable to diverse areas of application as it provides a secure, convenient, portable and practical solution to many sectors that make use of paper documentation, data labels and markings for products, goods and other entities. The following are some of the main areas of application.

Documents

Secure license systems (Especially for central, local and semi-government organizations—drivers licenses, pilots licenses)

Identity documents

Traffic authorities that can read license details, vehicle papers, license disks as well as to digitally photograph an accident scene with the same cellular digital camera and relay these back to central servers for authentication and recording.

Immigration documents, refugee documents, visas and passports

Permits such as work permits and weapons permits

Certificates such as diplomas, degrees and passed subject listings

Policies such as insurance policies

Contracts

Share certificates

Documents of monetary value

Export, import and custom documentation

Invoices and delivery documentation

Secure tickets and event permits

Labels

Shipping labels for containers and goods

Delivery labels on goods and containers

Quality control and standards authority verification labels

Authenticity verification labels (anti-cloning)

Vehicle number plates

Visitors permits

Marking

Vehicle marking for theft prevention

Secure parts marking with guaranteeing authenticity, standards and quality

Medicine container marking, for authenticity as well as contents information

The process described above is a particular example of how the invention is used in a typical solution. The concept, process and components can be adapted to a number of applications.

The above mentioned components and process can be adapted and combined with a number of existing and emerging technologies. The following are a few practical examples.

In order to remotely image machine-readable data (in the form of two-dimensional barcodes), a number of emerging digital image-enabled devices can be used to acquire and communicate the image data as an alternative to cellular telephones or fax machines.

There are a number of satellite phones emerging that have digital cameras. These can be used to communicate the images to authentication servers all over the world.

There are also many digitally image-enabled portable/hand held computers that are emerging, with various forms of remote communication such as GSM communication and spread spectrum radio communication. Since these devices have their own operating systems and can execute custom developed programs, the devices can carry out the decoding, decompression and decryption functions on the actual device and many of the central server applications can be ported to the portable device itself. Some of these have or eventually will have the ability to capture live video, which will allow for the capture of large volumes of two-dimensional barcodes, allowing for mass machine readable document or label capture and communication to central servers.

Interchangeable digital cameras that support imagery in different areas of the spectrum or the ability to switch the light source of these to different spectrums (for example infra red and ultra violet) will allow for additional copy protection as well as the use of invisible machine readable code.

Security can be increased by including digital image watermarks within two-dimensional barcode images. The digital image watermarks will be embedded in the two-dimensional barcode image and will be acquired during image acquisition and transmitted with the images for authentication and verification. These will enhance the protection against fraudulent creation and document origins will also be able to be confirmed by these.

The invention is well suited to be integrated with other technologies. The digital certificates, keys, passwords, personal details and biometrics templates for the two-dimensional document symbols and supporting document databases can be derived from secure chip based devices such as smart cards and USB secure chip devices. The security details held on these secure chip based devices can be passed to the document creation transactions and represented in the document databases (that are referenced by the document two-dimensional barcode) as well as to the document two-dimensional symbol itself.

A highly flexible label can be created using this invention and RF Tag technology. The ability to read such a label at any location with a cellular phone as well as the fact that it can be automatically tracked at certain locations allows for the maximum security and flexibility in a large range of secure asset tracking scenarios.

What is claimed is:

1. A method of creating and authenticating a document, the method comprising:

registering a user of a document creation system as a document creator, the registering including recording user identification data, user biometric data, and contact information for the user, and allocating a unique user identity code to the user;

creating a document having a user discernable portion and an encoded portion, the encoded portion including identification data identifying the registered user, contents data corresponding to at least part of the user discernable portion of the document, and authentication data;

creating a central record of the document in a central database, the central record comprising data corresponding at least partially to the data in the encoded portion of the document;

wherein at least one of the encoded portion of the document or the respective central record in the central database includes instructions for contacting the registered user as part of a document authentication process;

receiving an image of the encoded portion of the document during the document authentication process;

decoding the image to extract the data contained therein; and authenticating the document by contacting the respective registered user of the document creation system using the instructions, transmitting at least a portion of the instructions to the registered user, receiving current identification data from the registered user in accordance with the transmitted instructions, and comparing the received current identification data with data in the central record and the data extracted from the encoded portion of the document to verify the respective registered user as the document creator.

2. A method according to claim 1 wherein the method further comprises allocating a unique document identification code to the document.

3. A method according to claim 2 wherein the unique document identification code comprises data indicating the nature of the document, and a data/time stamp.

4. A method according to claim 3 wherein the unique document identification code is included in the encoded portion of the document and in the central record of the document.

5. A method according to claim 1 wherein the identification data identifying the user of the document creation system comprises a unique user identity code.

6. A method according, to claim 1 wherein the authentication data comprises biometric data obtained from the user.

7. A method according to claim 6 wherein the biometric data comprises fingerprint or voiceprint data.

8. A method according to claim 5 wherein the unique user identity code, together with personal details of the user and the authentication data, is stored in a database as a central record accessible for authentication purposes.

9. A method according to claim 1 wherein the instructions comprise a password to be spoken by a user of the document creation system to identify the user biometrically.

10. A method according to claim 1 wherein the encoded portion of the document is a machine-readable symbol that is printed in a size and format suitable for acquisition by a conventional imaging device to permit acquisition and transmission of the encoded portion of the document to an authentication center.

11. A method according to claim 10 wherein the size and format of the encoded portion are selected to be compatible with conventional fax machines and relatively low resolution digital cameras provided on mobile telephones.

12. A method according to claim 11 wherein the encoded portion is printed in a size, density and format that can successfully be acquired by imaging devices having a resolution of 200 DPI or less.

13. A method according to claim 10 wherein the encoded portion of the document is printed, as a two-dimensional symbolic barcode.

14. A method according to claim 13 wherein the two-dimensional symbolic barcode is encrypted and incorporates error correction data.

15. A method according to claim 1 wherein the current identification data received from the user is biometric data.

16. A method according to claim 15 wherein the biometric data is fingerprint data.

17. A method according to claim 15 wherein the biometric data is voiceprint data.

18. A method according to claim 1 wherein the instructions comprise a password to be spoken by the user of the document creation system to permit acquisition of a current voiceprint for comparison against a stored voiceprint of the password.

19. A system for creating and authenticating a document, the system comprising:

a secure document creation computer system accessible by a user registered as a document creator to create an authentic document having a user discernable portion and an encoded portion, the encoded portion including identification data identifying the registered user, contents data corresponding to at least part of the user discernable portion of the document, and authentication data;

a computer data storage device upon which a central database is stored, said central database storing a central record of the document comprising data corresponding at least partially to the data in the encoded portion of the document;

wherein at least one of the encoded portion of the document or the respective record in the central database include instructions for contacting the registered user as part of a document authentication process; and an authentication center for receiving an image of the encoded portion of the document to be authenticated, decoding the image to extract the data contained therein, and authenticating the document by comparing the extracted data with data in the respective central record and current identification data received from the registered user, the authentication center comprising a server arranged to contact the registered user identified in the encoded portion of the document using the instructions, transmit at least a portion of the instructions to the registered user, and receive the current identification data from the registered user in accordance with the instructions.

20. A system according to claim 19 wherein the current identification data is voiceprint data and the authentication center servicer is a voice identification server, the voice identification server being arranged to contact the document creator/signatory and to guide the document creator/signatory through a voice identification procedure with voice commands.

21. The method of creating a document of claim 1 wherein the instructions for contacting the registered user include a telephone number for calling the registered user.

22. The system for creating and authenticating a document of claim 19 wherein the instructions for contacting the registered user include a telephone number for calling the registered user.

* * * * *